United States Patent [19]

Hsu

[11] Patent Number: 5,068,012

[45] Date of Patent: Nov. 26, 1991

[54] THREE DIMENSIONAL MULTI-COATING PROCESS

[76] Inventor: Shih C. Hsu, No. 6, Alley 3, Lane 181, Min Tsu Rd., Ta Wan Tsun, Yung Kang Hsiang, Tainan Hsien, Taiwan

[21] Appl. No.: 556,394

[22] Filed: Jul. 24, 1990

[51] Int. Cl.[5] ..... C25D 1/20

[52] U.S. Cl. ..... 204/8; 204/18.1

[58] Field of Search ..... 204/4, 8, 18.1

[56] References Cited

U.S. PATENT DOCUMENTS 4,869,760 9/1989 Matsunami ..... 204/8

*Primary Examiner*—T. M. Tufariello

*Attorney, Agent, or Firm*—Morton J. Rosenberg; David I. Klein

[57] ABSTRACT

A process is provided for providing a three dimensional multi-coating design having a predetermined thickness contour on plastic products. Initially, a coating is electroplated on a plastic plate member and an adhesive tape is positioned on top of the coating design. The combined coating design and adhesive tape is impacted and the adhesive tape is peeled from the plastic plate member. The adhesive tape is placed on a printing screen and desired colors are printed on the contour design. The coating design is covered with adhesive and then further cover with oilpaper and finally thermally printed on to a base material through a standard heat transfer process. In this manner, a three dimensional design coating having a predetermined thickness is provided on the base member.

1 Claim, 3 Drawing Sheets

THREE DIMENSIONAL MULTI-COATING PROCESS

BACKGROUND OF THE INVENTION

This invention relates to the coating of varying designs on external members. Further, this invention directs itself to a process for providing a coating on plastic products which has a three dimensional effect. Still further, this invention relates to a multi-coating process for plastic products which is aesthetically pleasing. More in particular, this invention directs itself to a three dimensional multi-coating process for coating three dimensional designs on plastic products in an efficient and cost effective manner.

PRIOR ART

Plastic products having designs of varying configuration and color are known in the art. However, such designs apply to known plastic products generally are only variational in their design contours and the colors applied. The prior art known to Applicant does not provide for the printing of a three dimensional multi-coating on plastic products to give an external viewer a three dimensional effect and optimization of the aesthetic effect.

SUMMARY OF THE INVENTION

A three dimensional multi-coating process is provided wherein the initial step is electroplating a predetermined design coating on a plastic plate member with the design coating having a predetermined thickness contour. The plastic plate design coating is placed in adhesive contact with an adhesive tape layer. The upper surface of the adhesive tape is impacted for transferring the design coating to the adhesive tape. The adhesive tape is removed from the plastic plate member and is print screened with some predetermined colors. Adhesive is applied to the design coating and the design coating is covered with oil paper and then the design coating is thermally transferred to a plastic member.

It is an object of the present invention to provide a three dimensional multi-coating to a plastic product and provides for an improved method of printing three dimensional multi-coatings on the plastic products.

It is another object of the present invention to provide a three dimensional multi-coating process for plastic products which save time and costs involved in the processing steps.

It is still another object of the present invention to provide a three dimensional multi-coating process on plastic products which makes the plastic products aesthetically pleasing and allows variational colors.

It is still another object of the present invention to provide a three dimensional multi-coating process on plastic products which is cost effective and inexpensive to produce.

DETAILED DESCRIPTION OF THE PREFERRED EMBODIMENTS

Figure 1:
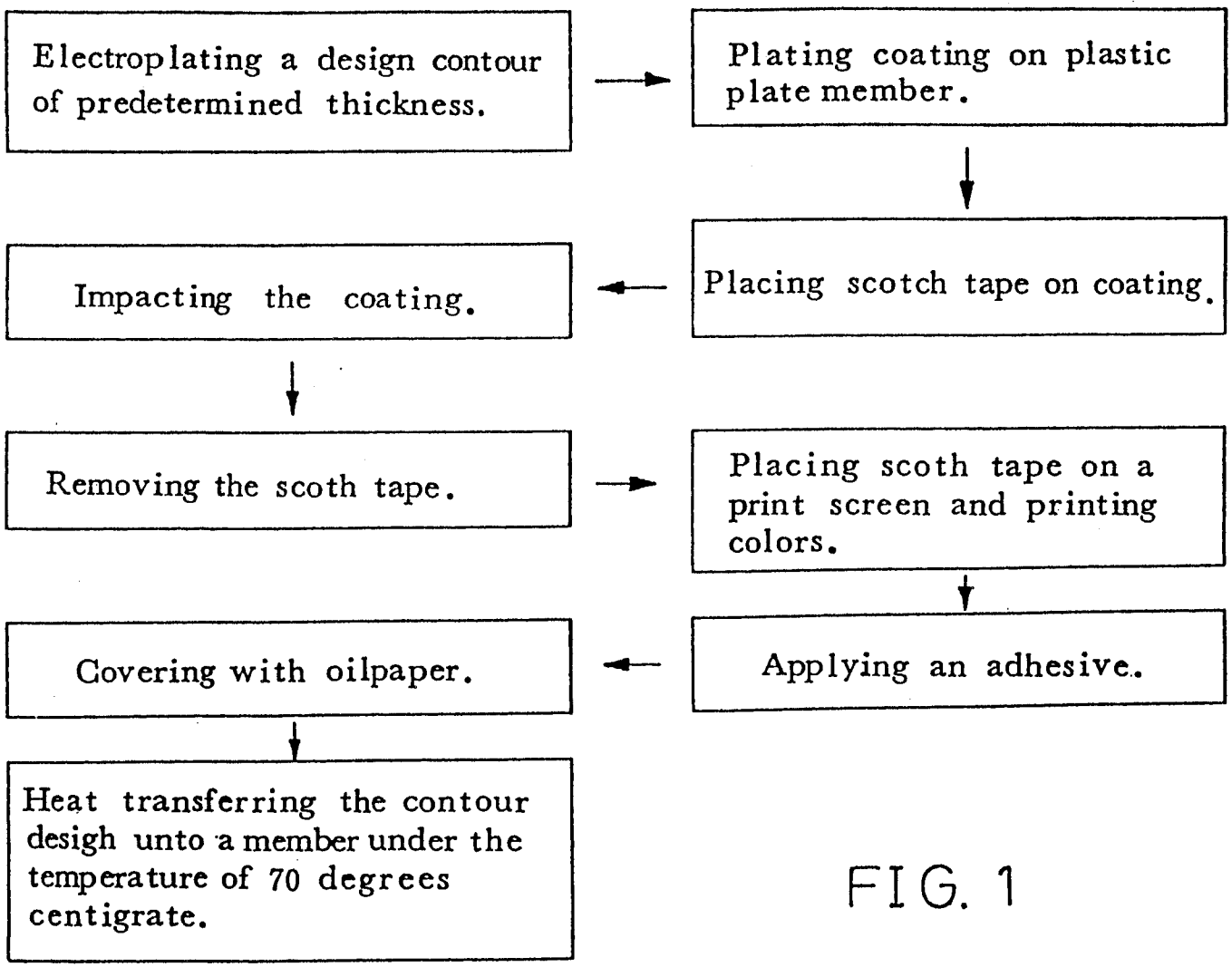
FIG. 1 is a block diagram showing the steps of the present invention method concept.
Figure 2:
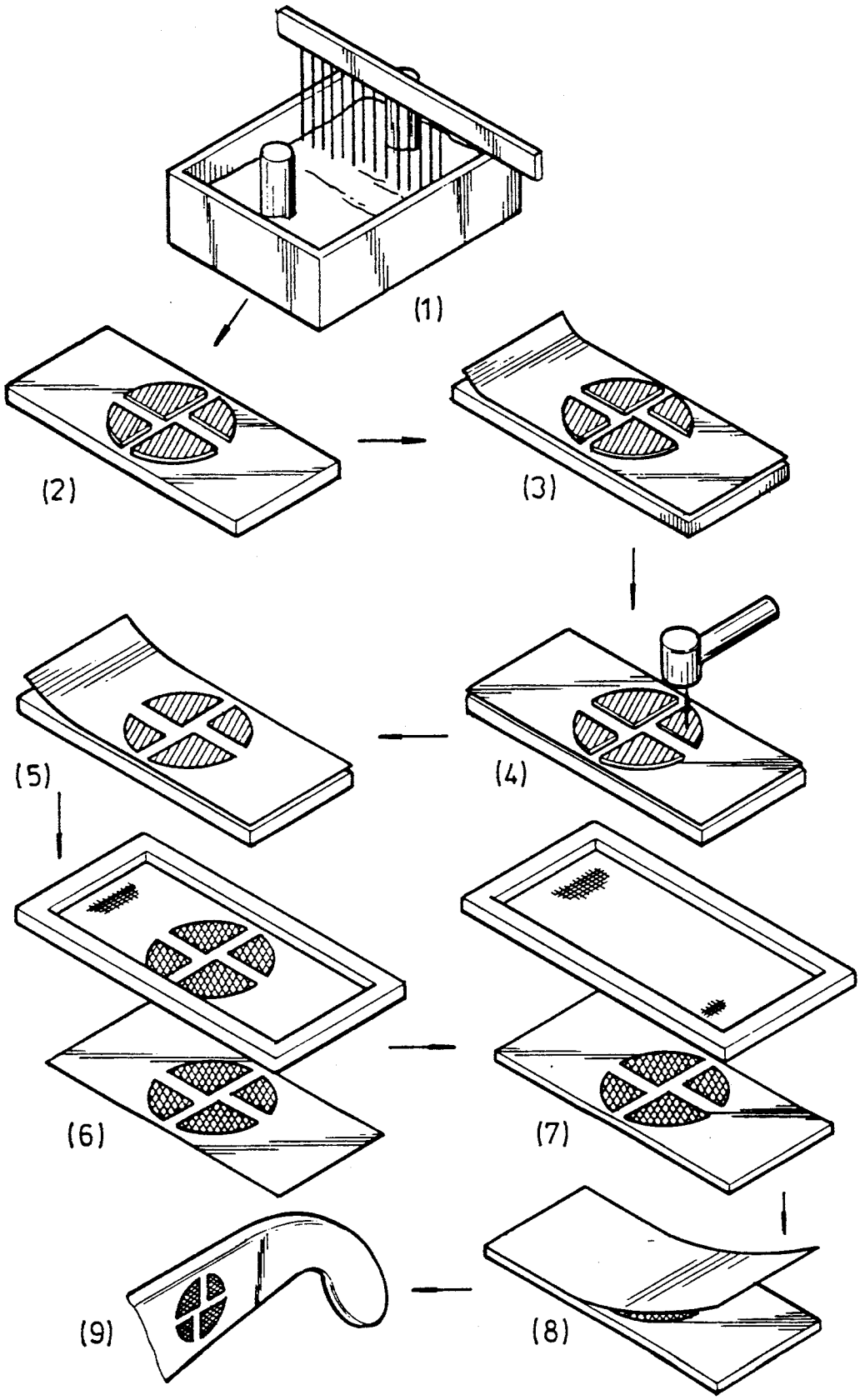
FIG. 2 is a three dimensional flow chart showing the steps of the present invention.

Referring now to FIGS. 1-3, there is shown a three dimensional multi-coating process for providing a three dimensional coating design on a plastic product. Specifically, the overall invention concept method may relate to an integrally ejected product of plastic material.

Figure 3A:
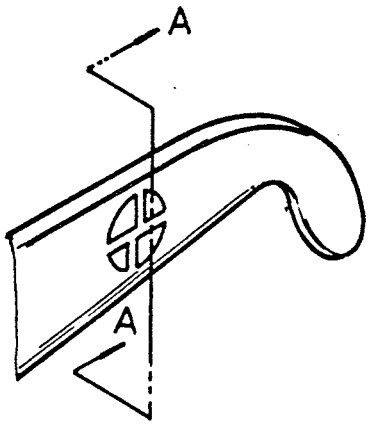
FIG. 3A is a perspective view of the present invention showing the three dimensional design coating applied to the temple of a pair of eyeglasses; and, FIG. 3B is a cross-sectional view taken along the cross-sectional line 3A—3A of FIG. 3A.

Referring now to FIGS. 1-3, the coating method as herein described may, as an example, be used on plastic eyeglass temples as shown in FIG. 3A.

Figure 3B:
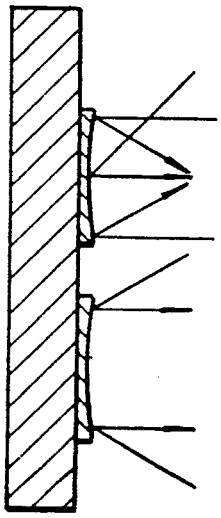

Initially, a predetermined design coating is electroplated on a plastic plate member as shown in FIG. 2. The design coating being applied to the plastic plate member has a predetermined thickness contour which can be seen in FIG. 3B. In FIG. 3B, the thickness contour of various segments of the design coating is concave in contour in order to provide differing aesthetic effects, obviously resulting from different focal points and may be provided with variations in colors at the discretion of the user. The electroplating step is a standard electroplating deposition of a thin layer of coating of a metal on the plastic plate member by passing an electric current through some type of solution of a salt containing ions of the particular element being deposited, not important to the invention concept as herein described, with the exception that the design coating is formed on the plastic plate member with some predetermined thickness contour.

The plastic plate member containing the predetermined design coating is placed in adhesive contact with an adhesive tape layer as shown in FIG. 2 with the adhesive layer possibly being Scotch tape.

The combined adhesive tape layer and plastic plate member is impacted by a hammer or like implement for transferring the design coating from the plastic plate member to the adhesive tape. In this manner, the design coating of the plastic plate is secured to the Scotch tape layer.

The adhesive tape is then removed or peeled from the plastic plate member and applied to a mold or standard print screen member as seen in FIG. 2. Predetermined colors are then printed onto the design coating in either one color or varying colors at the discretion of the user.

An adhesive is applied to the predetermined design coating and covered with oil paper. Once this is done, the design coating may be thermally transferred through some type of heat input implement well-known in the art, with the exception that the temperature should be less than approximately 70° C.

The final design contour formed on, for example, the temple of an eyeglass is shown in FIG. 3A and the varying predetermined thickness contour shown in the cross-sectional drawing of FIG. 3B showing that the predetermined design coating contour causes varying light reflections that allow for the final design to be seen by an external viewer in a three dimensional effect.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

I claim:

1. A three dimensional multi-coating process including the steps of:

(a) electroplating a predetermined design coating on a plastic plate member, said design coating having a predetermined thickness contour;

(b) placing said plastic plate design coating in adhesive contact with an adhesive tape layer;

(c) impacting an upper surface of said adhesive tape for transferring said design coating to said adhesive tape;

(d) removing said adhesive tape from said plastic plate member;

(e) print screening predetermined colors into said design coating;

(f) applying adhesive to said design coating;

(g) covering said design coating with oilpaper; and, (h) thermally transferring said design coating to a plastic member.

* * * * *